US011134726B2

(12) United States Patent
Sitzmann

(10) Patent No.: US 11,134,726 B2
(45) Date of Patent: Oct. 5, 2021

(54) NECK SUPPORT DEVICE

(71) Applicant: Sitzmann Tools, LLC, Seattle, WA (US)

(72) Inventor: Beau Sitzmann, Seattle, WA (US)

(73) Assignee: Sitzmann Tools, LLC, Seattle, WA (US)

( * ) Notice: Subject to any disclaimer, the term of this patent is extended or adjusted under 35 U.S.C. 154(b) by 0 days.

(21) Appl. No.: 16/503,214

(22) Filed: Jul. 3, 2019

(65) Prior Publication Data

US 2020/0008498 A1 Jan. 9, 2020

Related U.S. Application Data

(60) Provisional application No. 62/693,621, filed on Jul. 3, 2018.

(51) Int. Cl.

| | |
|---|---|
| ***A47C 16/00*** | (2006.01) |
| ***A41D 13/05*** | (2006.01) |
| ***A47C 7/38*** | (2006.01) |
| ***A47C 20/00*** | (2006.01) |
| ***A47C 20/02*** | (2006.01) |

(52) U.S. Cl.

CPC ..... *A41D 13/0512* (2013.01); *A47C 7/383* (2013.01); *A47C 16/00* (2013.01); *A47C 20/021* (2013.01); *A47C 20/022* (2013.01); *A47C 20/023* (2013.01); *A41D 2400/32* (2013.01); *A41D 2400/42* (2013.01); *A41D 2600/20* (2013.01)

(58) Field of Classification Search

CPC ..... A47C 7/383; A47C 16/00; A47C 4/00

See application file for complete search history.

(56) References Cited

U.S. PATENT DOCUMENTS

| | | | | |
|---|---|---|---|---|
| 5,001,791 A * | 3/1991 | Toso | ..... | A47C 4/52 297/464 |
| 5,643,184 A * | 7/1997 | Toso | ..... | A47C 16/00 2/44 |
| 2015/0042143 A1* | 2/2015 | Maginness | ..... | A47C 7/383 297/393 |

* cited by examiner

*Primary Examiner* — Fredrick C Conley
(74) *Attorney, Agent, or Firm* — Polsinelli

(57) ABSTRACT

In one embodiment, a neck support device includes: first and second leg attachment portions; a head cradle; and a first coupling portion attaching the first leg attachment portion to the head cradle and a second coupling portion attaching the second leg attachment portion to the head cradle. In another embodiment, a method of supporting the neck of a user when the user is laying on his or her back or supporting the back of a user when the user is in a seated position includes: attaching the first leg attachment portion to the first leg of the user; attaching the second leg attachment portion to the second leg of the user; and fixing the head cradle.

11 Claims, 6 Drawing Sheets

NECK SUPPORT DEVICE

CROSS-REFERENCE TO RELATED APPLICATION

This application claims the benefit of U.S. Provisional Patent Application No. 62/693,621, filed Jul. 3, 2018, the disclosure of which is incorporated herein by reference in its entirety.

BACKGROUND

For people working on their backs on overhead projects, such as plumbers working on under-sink plumbing and insulation installers working on crawl-space insulation, it can be difficult to support one's neck for extended periods of time.

Therefore, there exists a need for a device for neck support.

SUMMARY

In accordance with one embodiment of the present disclosure, a neck support device is provided. The neck support device includes: first and second leg attachment portions; a head cradle; and a first coupling portion attaching the first leg attachment portion to the head cradle and a second coupling portion attaching the second leg attachment portion to the head cradle.

In accordance with another embodiment of the present disclosure, a method of supporting the neck of a user when the user is laying on his or her back or supporting the back of a user when the user is in a seated position is provided. The method includes: obtaining a neck support device including first and second leg attachment portions, a head cradle, and a first coupling portion attaching the first leg attachment portion to the head cradle and a second coupling portion attaching the second leg attachment portion to the head cradle; attaching the first leg attachment portion to the first leg of the user; locating the first coupling portion along the first side of the torso of the user; locating the second coupling portion along the second side of the torso of the user; attaching the second leg attachment portion to the second leg of the user; and fixing the head cradle.

In any of the embodiments described herein, either or both of the first and second leg attachment portions may be configured to couple above the knee of the user.

In any of the embodiments described herein, either or both of the first and second leg attachment portions may be configured to couple to the foot of the user.

In any of the embodiments described herein, the first leg attachment portion may be configured to couple above the knee of the user and the second leg attachment portion may be configured to couple to the foot of the user.

In any of the embodiments described herein, the head cradle may be adjustable for the head size of the user.

In any of the embodiments described herein, the first coupling portion and the second coupling portion may be adjustable in length depending on the size of the user.

In any of the embodiments described herein, the first coupling portion and the second coupling portion may be made from strap material.

In any of the embodiments described herein, the first coupling portion and the second coupling portion and at least a portion of the head cradle may be integrally formed from the same strap.

In any of the embodiments described herein, the first and second leg attachment portions may each form a loop around the leg or foot of the user.

In any of the embodiments described herein, the neck support device may further include a storage pouch for the neck support device, wherein the storage pouch may be attachable to the user's body by a pouch attachment system.

In any of the embodiments described herein, fixing the head cradle may include fixing the head cradle on the user's head.

In any of the embodiments described herein, a method may further include adjusting the head cradle for the head size of the user.

In any of the embodiments described herein, fixing the head cradle may include fixing the head cradle behind the user's neck.

In any of the embodiments described herein, attaching the first leg attachment portion to the first leg of the user may include forming a loop around the first leg of the user, or attaching the second leg attachment portion to the second leg of the user may include forming a loop around the second leg of the user, or both.

In any of the embodiments described herein, attaching the first leg attachment portion to the first leg of the user may include attaching the first leg attachment portion to the user's first leg above the knee of the user or to the user's first foot.

In any of the embodiments described herein, attaching the second leg attachment portion to the second leg of the user may include attaching the first leg attachment portion to the user's second leg above the knee of the user or to the user's second foot.

In any of the embodiments described herein, a method may further include adjusting the first and/or second coupling portions in length depending on the size of the user.

In any of the embodiments described herein, a method may further include adjusting the first and/or second leg attachment portions depending on the size of the user.

In any of the embodiments described herein, the first coupling portion and the second coupling portion and at least a portion of the head cradle may be integrally formed from the same strap.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 7:
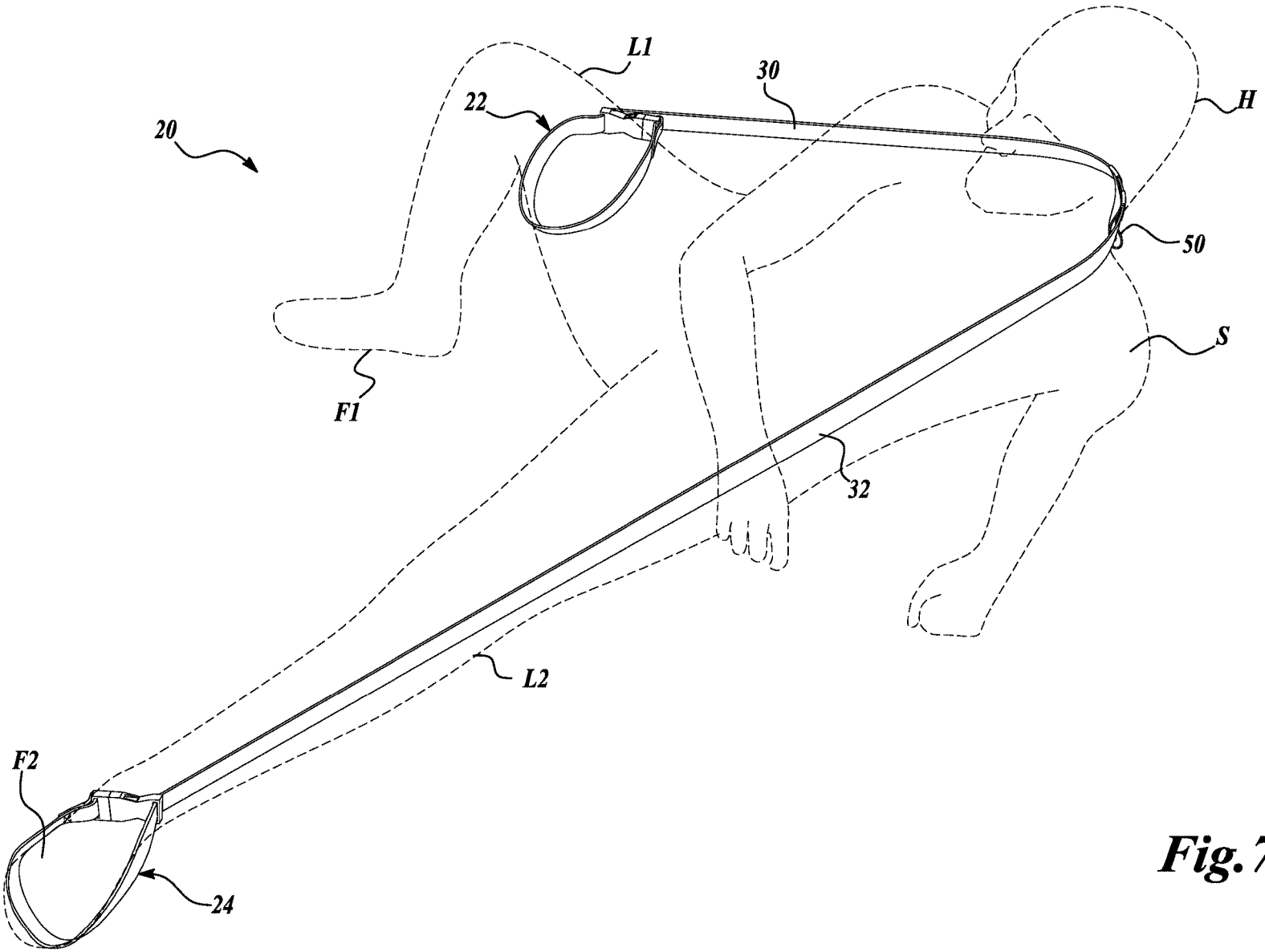
FIG. 7 is a perspective view of the neck support device of FIG. 1 in an extended configuration and attached to a user's body while seated in a second working position in accordance with embodiments of the present disclosure.

Embodiments of the present disclosure are directed to neck support devices and methods of supporting one's neck, for example, when the user U is lying on his or her back (see FIG. 4) or in a seated position (see FIG. 7). In one embodiment, with reference to FIGS. 1-6, a neck support device 20 includes first and second leg attachment portions 22 and 24, a head cradle 26, and a first coupling portion 30 attaching the first leg attachment portion 22 to the head cradle 26 and a second coupling portion 32 attaching the second leg attachment portion 24 to the head cradle 26.

Figure 1:
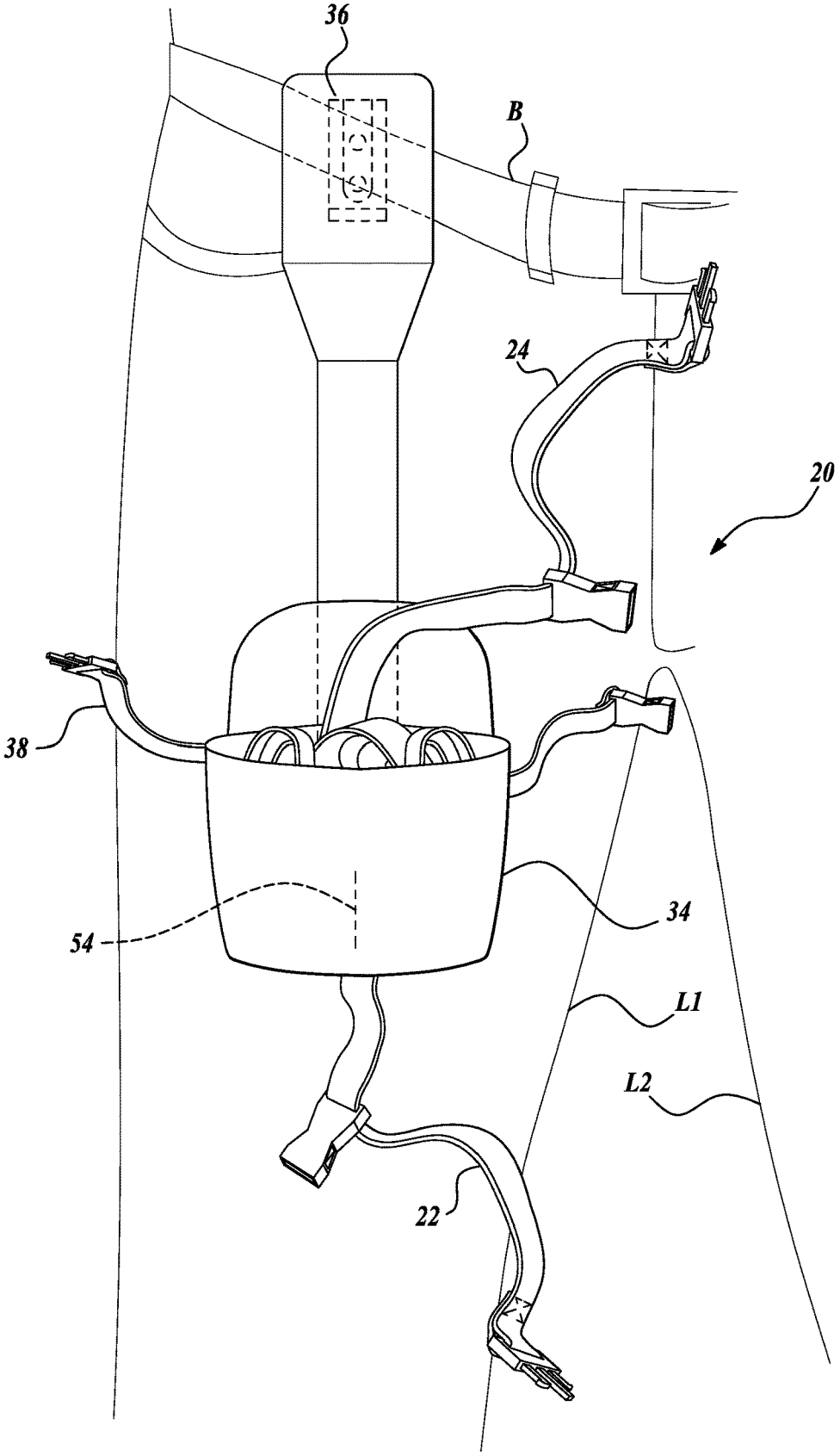
FIG. 1 is a front view of a neck support device in a stowed configuration in accordance with one embodiment of the present disclosure.
Figure 2:
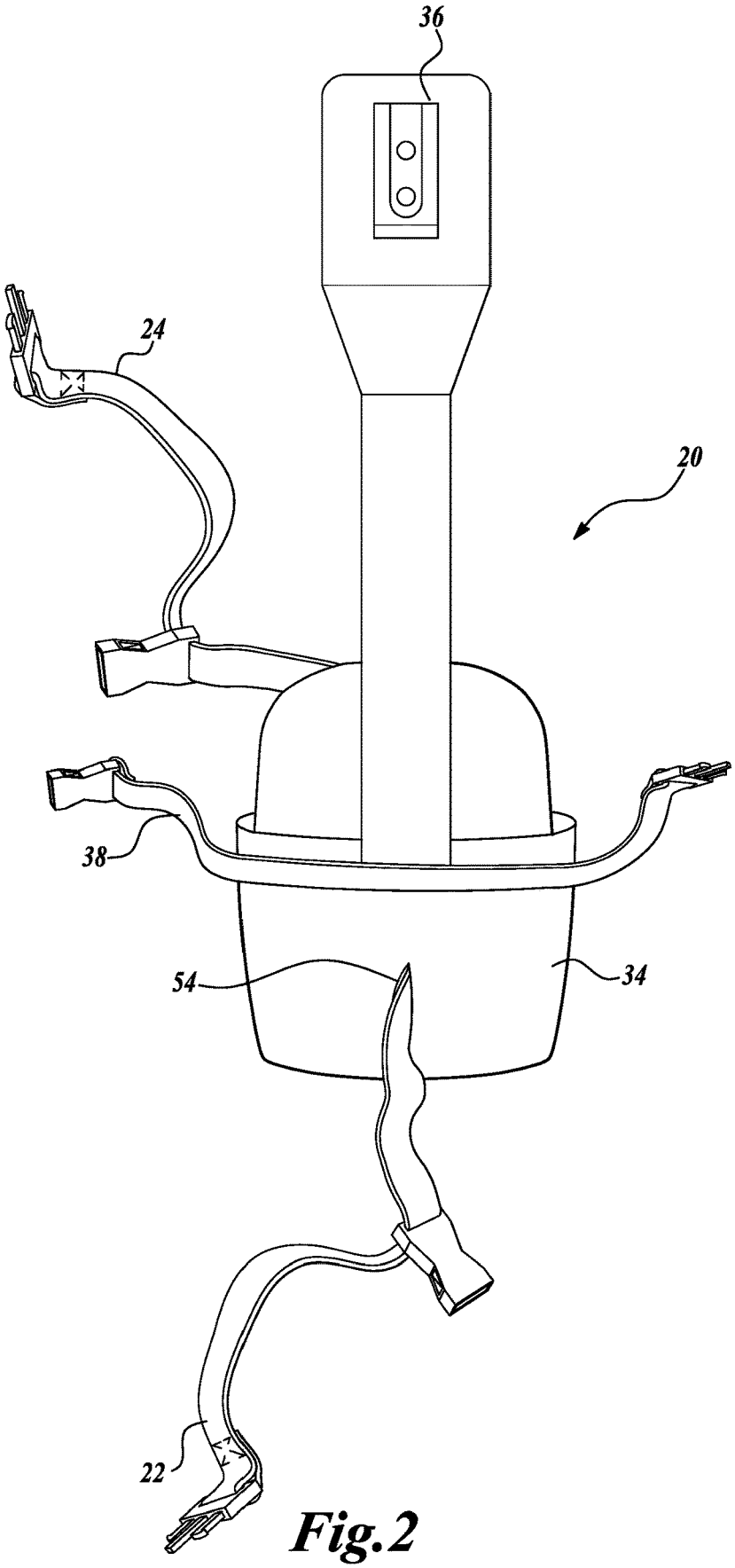
FIG. 2 is a rear view of the neck support device in the stowed configuration of FIG. 1.

Referring to FIGS. 1 and 2, the neck support device 20 may be optionally stowed in a carrying pouch 34 configured for attaching to the first leg L1 of the user U and the belt B or pocket of the user's pants. In the illustrated embodiment of FIGS. 3 and 4, the carrying pouch 34 is not shown for simplification of the drawings. However, a carrying pouch may be incorporated into the neck support device 20 of FIGS. 3 and 4. The carrying pouch 34 may be configured for right- or left-handed use and the carrying pouch 34 can be attached to the user's right leg or left leg.

Still referring to FIGS. 1 and 2, the pouch 34 can be secured to the user's body by a pouch coupling system, for example, including an optional coupling 36 to a belt or pocket of the user's pants, which extends to the pouch 34 and holds the pouch 34 on the user's leg, and a pouch leg attachment portion 38 for securing the pouch 34 to the user's leg L1.

Figure 3:
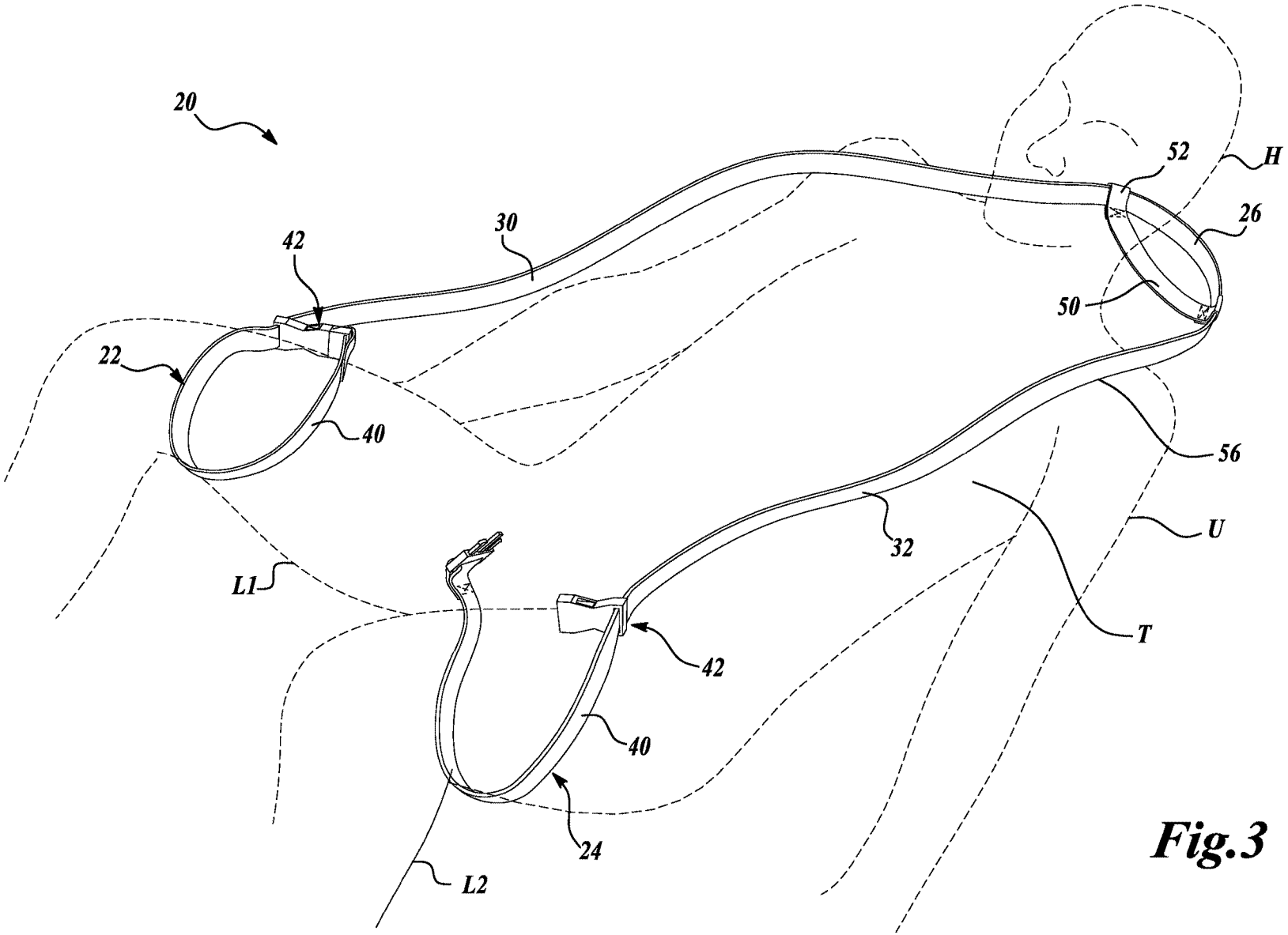
FIG. 3 is a perspective view of the neck support device of FIG. 1 in an extended configuration and being attachable to a user's body while lying on his or her back in a first working position in accordance with embodiments of the present disclosure.

The first leg attachment portion 22 of the neck support device 20 extends from a hole 54 in the pouch 34 and can be attached to the first leg L1 of the user U before the user positions his or her body into a position lying on his or her back, as seen in FIG. 3 (which is shown without a carrying pouch 34 for clarity in the drawing regarding the neck support device 20). The remaining portions of the neck support device 20 remain in a stowed configuration in the pouch 34 and are accessible to the user U when the user U is position for using the neck support device 20.

Figure 4:
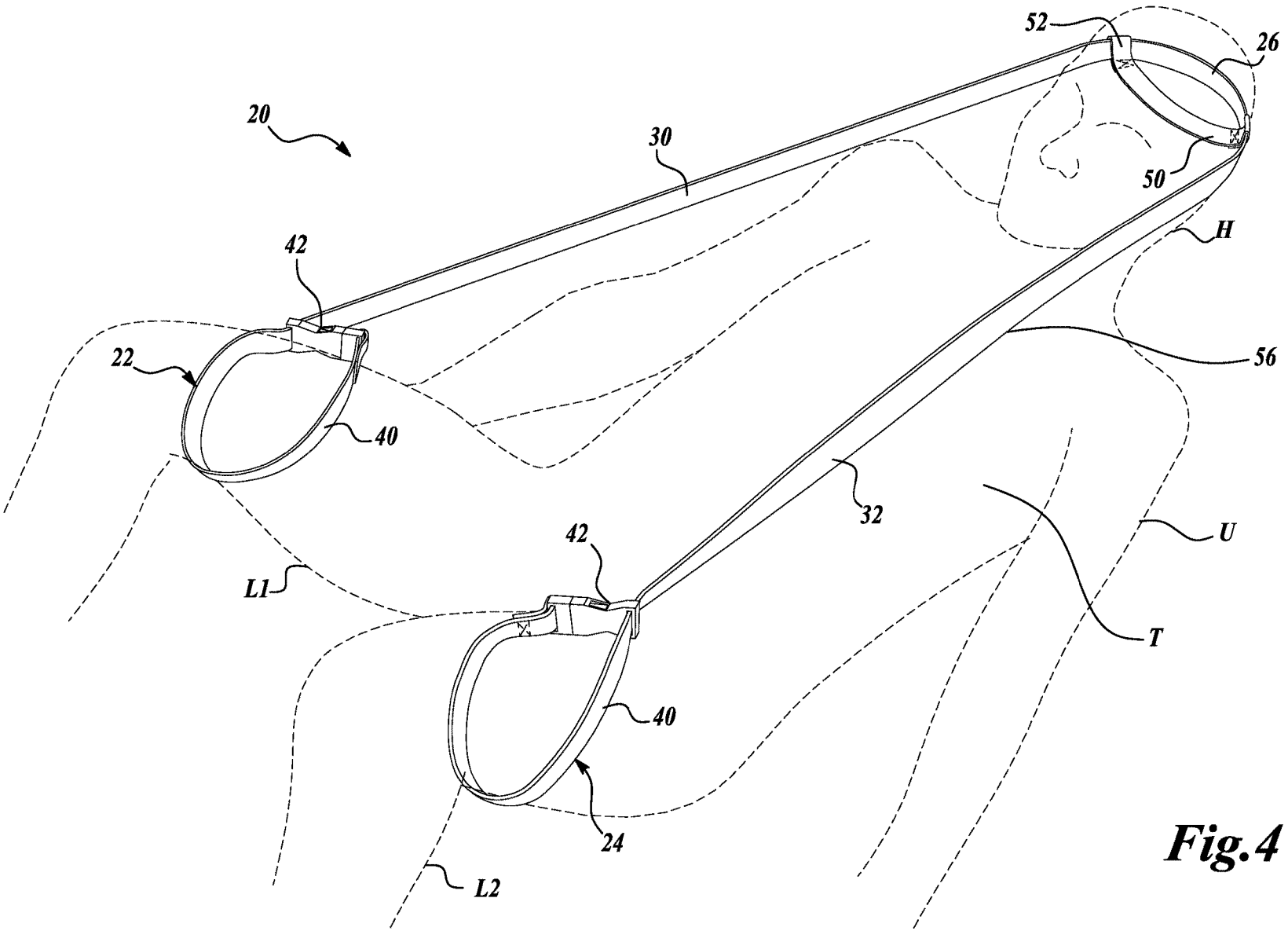
FIG. 4 is a perspective view of the neck support device of FIG. 1 in an extended configuration and attached to a user's body while lying on his or her back in a first working position in accordance with embodiments of the present disclosure.
Figure 6:
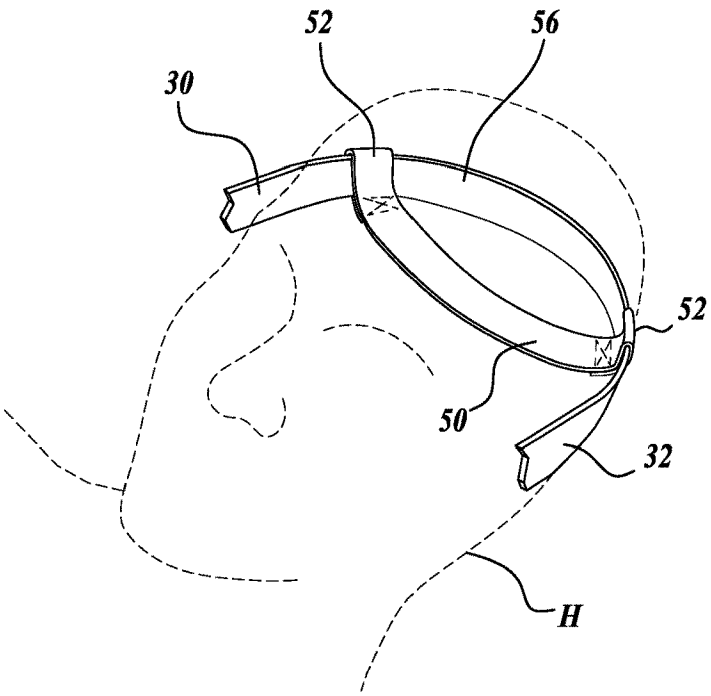
FIG. 6 is a close-up perspective view of a head cradle of the neck support device of FIG. 1 in accordance with embodiments of the present disclosure.

Referring to FIGS. 3 and 4, in accordance with one embodiment of the present disclosure, the user U can take the neck support device 20 (for example, from the pouch 34 shown in FIGS. 1 and 2) and attach it to his or her body in a working configuration while lying on his or her back in a first working position. Referring to FIGS. 3 and 4, after the neck support device 20 is already attached to the user's first leg L1, the user U places the neck support device 20 around his or her neck and attaches the second leg attachment portion 24 to his or her second leg L2. After the leg attachment portions 22 and 24 are secured, the user U can adjust the head cradle 26 on his or her head H, as described in greater detail below.

In the illustrated embodiment, of FIGS. 1 and 2, the neck support device 20 is stowed in the pouch 34. The pouch 34 is coupled to the user's belt B and the user's leg L1 via the pouch leg attachment portion 38. The neck support device 20, although stowed in the pouch 34, is not coupled to the pouch 34. Instead, first leg attachment portion 22 extends through hole 54 in pouch 34 to allow for attachment to the user's first leg L1.

The hole 54 in the pouch 34 may be sized and configured (for example, as a slot) such that it is not easy to pass the buckle 42 of the first leg attachment portion 22 through the hole 54. In this matter, the first leg attachment portion 22 cannot be pulled through the hole 54 when the user U is attaching the neck support device 20 to his or her body.

The pouch 34 is designed and configured for user U ease of storage and ease of use. However, the pouch 34 is an option component, and neck support devices and methods of using neck support devices without pouches are within the scope of the present disclosure. For example, in the illustrated embodiment of FIGS. 3 and 4 body attachment of the neck support device 20 without a pouch for storage 34 is illustrated.

Figure 5:
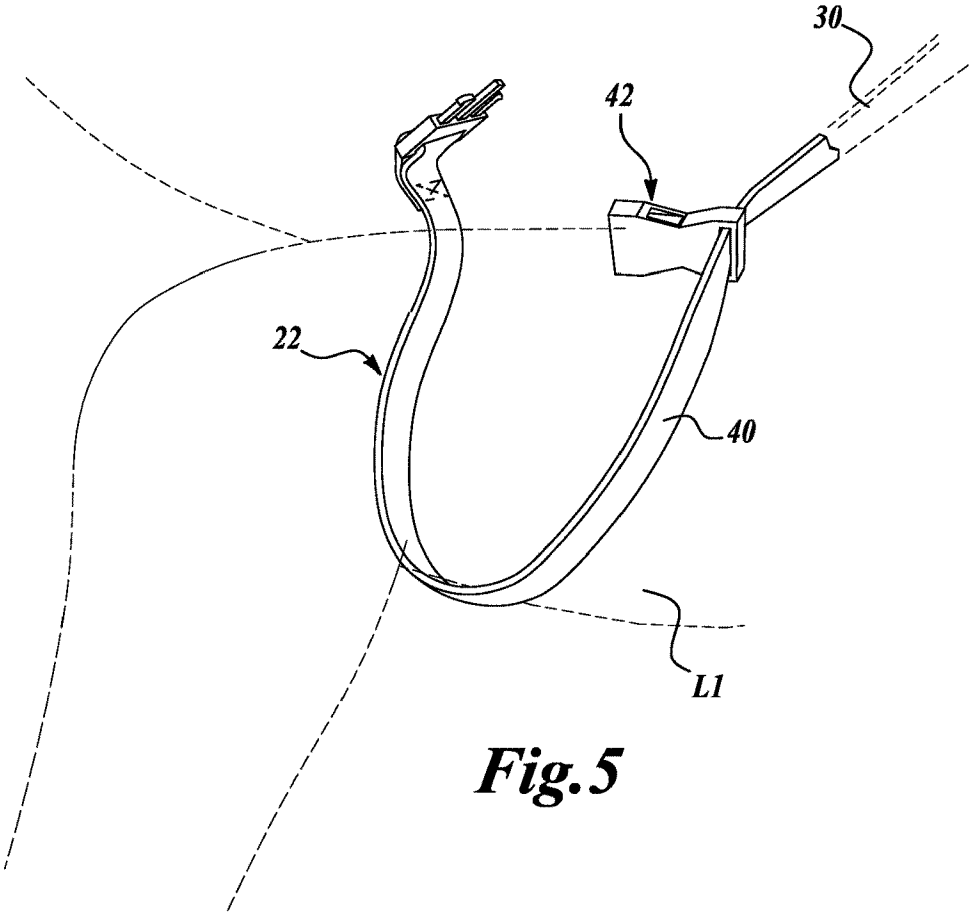
FIG. 5 is a close-up perspective view of a leg attachment portion of the neck support device of FIG. 1 in accordance with embodiments of the present disclosure.

As seen in the illustrated embodiment of FIGS. 3 and 4, the first and second leg attachment portions 22 and 24 are straps 40 that wrap around the respective users legs L1 and L2 above the knees. The straps 40 are secured to and released from the users legs L1 and L2 by buckles 42, such as two-pin side-release buckles, for ease of attachment and release, as seen in FIG. 5. However, other types of buckles and other suitable attachment devices may be used in accordance with embodiments of the present disclosure. As will be described in greater detail below, a wrap-around attachment of the first and second leg attachment portions 22 and 24 to the respective first and second legs L1 and L2 of the user U provide leverage and allow the user U to use his or her legs to control the support function of the neck support device 20.

Referring to FIG. 4, after the first and second leg attachment portions 22 and 24 are secured, the user U fixes the head cradle 26 on his or her head H. With the head cradle 26 positioned on the user's head H, the first and second coupling portions 30 and 32 extending between each of the first and second leg attachment portions 22 and 24 to the head cradle 26 extend along the first and second sides of the torso T of the user U. In the position of the user in the illustrated embodiment of FIG. 4, the first and second coupling portions 30 and 32 may along the first and second sides of the torso T of the user U between the user's head H and each of the user's legs L1 and L2 and with enough tension to support the head H of the user U.

In accordance with embodiments of the present disclosure, the neck support device 20 may be designed and configured to be adjustable to fit the body of the user U for comfort and function. For example, the neck support device 20 may have adjustability in the length of the first or second leg attachment portions 22 and 24, the first and second coupling portions 30 and 32, the head cradle 26, and the optional pouch leg attachment portion 38. Likewise, the neck support device 20 may be manufactured to size based on the body of the user U. For example, the first and second leg attachment portions 22 and 24 and/or the pouch leg attachment portion 38 may be adjusted or sized based on the leg L1 and L2 circumference of the user U. In the illustrated embodiment, the buckles 42 for connecting the first and second leg attachment portions 22 and 24 have a first buckling portion and a second buckling portion. The second bucking portion is shown to be adjustably attached to the strap 56 so as to be adjustable to the user's leg size during attachment. In use, when the strap 56 is under tension, the first and second leg attachment portions 22 and 24 will be coupled to the user's legs L1 and L2 with tension.

Likewise, the first and second coupling portions 30 and 32 may be adjusted or sized based on the length of the user's torso T.

Further, the head cradle 26 may be adjusted or sized based on the user's head H. In the illustrated embodiment, the looped ends 52 in the head cradle 26 allow for the head cradle 26 to be sized to fit the size of the user's head H.

In accordance with embodiments of the present disclosure, the neck support device 20 may be assembled from discrete parts or may be manufactured to integrate several parts into one. For example, referring to FIG. 6, a head cradle 26 in accordance with one embodiment of the present disclosure includes a head support portion 50 having looped ends 52 for receiving a single strap 56 which includes the first coupling portion 30 and the second coupling portion 32 and is configured to extend from the first leg attachment portion 22 to the second leg attachment portion 24. Accordingly, in the illustrated embodiment of FIG. 6, the first coupling portion 30, the second coupling portion 32, and at least a portion of the head cradle 26 are integrally formed from the same single strap 56. Likewise, at least some portions of the first and second leg attachment portions 22 and 24 may also be integrated into the same single strap 56 (see FIGS. 3 and 4).

Advantageous effects of a neck support device 20 designed and configured in accordance with embodiments of the present disclosure include neck support when a user is in a back-down working position, which may be in dark and/or tight spaces. Such neck support allows the user to rest his or her head against the head cradle 26 while working to reduce neck strain while working in a back-down working position. Further, the neck support device 20 is easy to set up in its support configuration from its stowed configuration and vice versa, so that the user is able to use the neck support device 20 in dark and/or tight space. Moreover, the neck support can be personalized to the comfort and needs of the user, either in sizing or in adjustability.

In addition, when the neck support device 20 is in use, the positioning of the user's legs L1 and L2 can be used to control the level and orientation of support and tension provided by the neck support device 20. For example, if the user needs to raise his or her head a little lower, the legs can be bent toward the user's torso with knees of the user positioned higher to shorten the length between the knees and the torso of the user. If the user needs to raise his or her head a little higher, the legs of the user can be extended with the knees of the user positioned lower to extend the length between the knees and the torso of the user. If the user needs to position his or her head at different angles to the left or the right side, the positioning of the legs can be varied.

The neck support device 20 can further be used in different configurations. Referring to FIG. 7, the head cradle 26 can be positioned behind the user's back to provide back support. Also seen in FIG. 7, the second leg attachment portion 34 of the neck support device 20 can be coupled to the user's foot F2 of the second leg L2 (instead of above the knee of the second leg L2 itself) to provide a different type of leverage for different working situations. In addition, the head cradle 26 is positioned behind the user's shoulder S to provide back support. In these configurations, the neck support device 20 can be used to provide support to the user U in a more seated working position, rather than in a back-down working position.

In another configuration not shown, the second leg attachment portion 34 of the neck support device 20 can be coupled to the user's foot F2 on the second leg L2 (instead of above the knee of the second leg L2) and the head cradle 26 may be positioned on the user's head H to provide a different type of leverage for different working situations.

In yet another configuration not shown, the first and second leg attachment portions 32 and 34 of the neck support device 20 can be coupled to both feet F1 and F2 on the respective first and second legs L1 and L2 of the user U and the head cradle 26 may be positioned on the user's head H or being the user's shoulder S to provide other different types of leverage for different working situations.

In non-working applications, the neck support device 20 can be used as a "chair" (for example, see FIG. 7) or as a sleeping or resting "bed" (for example, see FIG. 4).

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A neck support device, comprising:

first and second leg attachment portions;

a head cradle;

a first coupling portion attaching the first leg attachment portion to the head cradle and a second coupling portion attaching the second leg attachment portion to the head cradle; and wherein the head cradle supports a back portion of a user's head in tension when the first leg attachment portion is coupled to the user's first leg or foot and the second leg attachment portion is coupled to the user's second leg or foot.

2. The neck support device of claim 1, wherein the either or both of the first and second leg attachment portions are configured to couple above the knee of the user.

3. The neck support device of claim 1, wherein at least one of the tension level and orientation of the head cradle is adjustable when the distance between the knees and torso of the user is shortened or lengthened.

4. The neck support device of claim 1, wherein the first leg attachment portion is configured to couple above the knee of the user and the second leg attachment portion is configured to couple to the foot of the user.

5. The neck support device of claim 1, wherein the head cradle is adjustable for the head size of the user by sliding a head support portion relative to the first and second coupling portions.

6. The neck support device of claim 1, wherein the first coupling portion and the second coupling portion are adjustable in length depending on the size of the user.

7. The neck support device of claim 1, wherein the first coupling portion and the second coupling portion are made from strap material.

8. The neck support device of claim 1, wherein the first coupling portion and the second coupling portion and at least a portion of the head cradle are integrally formed from the same strap.

9. The neck support device of claim 1, wherein the first and second leg attachment portions each form a loop around the leg or foot of the user, wherein the loop is automatically adjustable to the user's leg or foot size when coupled to the user's leg or foot in tension.

10. The neck support device of claim 1, further comprising a storage pouch for the neck support device, wherein the storage pouch is attachable to the user's body by a pouch attachment system.

11. The neck support device of claim 1, wherein the second leg attachment portion is configured to couple to the user's second leg or foot after the first leg attachment portion is coupled to the user's first leg or foot, the first and second coupling portions extend along first and second sides of the user's torso, and the head cradle is positioned behind the user's head or neck.

* * * * *